US007447459B2

(12) United States Patent
Tamaoki et al.

(10) Patent No.: US 7,447,459 B2
(45) Date of Patent: Nov. 4, 2008

(54) IMAGE FORMATION DEVICE WHICH OPERATES IN A PLURALITY OF STARTUP MODES

(75) Inventors: Ryoji Tamaoki, Nagano-ken (JP); Shigeyuki Takahashi, Nagano-ken (JP); Nobuaki Takenaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 365 days.

(21) Appl. No.: 11/326,335

(22) Filed: Jan. 6, 2006

(65) Prior Publication Data

US 2006/0171733 A1 Aug. 3, 2006

(30) Foreign Application Priority Data

Jan. 11, 2005 (JP) ..... 2005-003805

(51) Int. Cl.
*G03G 15/00* (2006.01)
*G03G 15/01* (2006.01)

(52) U.S. Cl. ..... 399/81; 399/12; 399/82; 399/223

(58) Field of Classification Search ..... 399/81, 399/82, 227, 223, 119, 112, 12, 13
See application file for complete search history.

(56) References Cited

U.S. PATENT DOCUMENTS 5,036,367 A * 7/1991 Haneda et al. ..... 399/112
7,239,815 B2 * 7/2007 Takahashi ..... 399/12
2004/0240906 A1 12/2004 Yamada et al.
2005/0013625 A1 1/2005 Yoshizuka et al.
2005/0207789 A1 * 9/2005 Inukai et al. ..... 399/223
2006/0263107 A1 * 11/2006 Inukai et al. ..... 399/227 X

FOREIGN PATENT DOCUMENTS

JP 2003-50495 A 2/2003
JP 2004-233850 A 8/2004
JP 2004-361673 A 12/2004

* cited by examiner

*Primary Examiner*—Sophia S Chen
(74) *Attorney, Agent, or Firm*—Sughrue Mion, PLLC

(57) ABSTRACT

The present invention provides an image formation device having a plurality of startup modes in dependence upon the toner cartridge installed, with which the user can perform alteration of the startup mode in a simple and easy and moreover accurate manner. This image formation device is one to which a development unit containing toner is installed in a removable manner and which performs image formation using the toner contained in the development unit, and having a plurality of startup modes depending upon the installed development unit; the device including: a reception portion which receives an alteration request for the startup mode; a decision portion which, upon receipt of the alteration request, determines the development unit that is required to be operated, in order to startup in the requested startup mode; and an output portion which outputs guide information to the user, so that the determined development unit is operated.

6 Claims, 5 Drawing Sheets

IMAGE FORMATION DEVICE WHICH OPERATES IN A PLURALITY OF STARTUP MODES

CROSS-REFERENCE TO RELATED APPLICATIONS

This application is based upon and claims the benefit of priority from the prior Japanese Patent Application No. 2005-003805, filed on Jan. 11, 2005, the entire contents of which are incorporated herein by reference.

BACKGROUND OF THE INVENTION

1. Field of the Invention

The present invention relates to an image formation device such as a printer, a facsimile, a photocopier or the like which creates images using an electronic photographic technique, and, more particularly, relates to such an image formation device which can change startup mode in a simple and easy manner.

2. Description of the Related Art

Generally, with an image formation device such as a printer, a facsimile, a photocopier or the like which creates images using an electronic photographic technique, image formation is performed by creating an electrostatic latent image according to image data, supplying a toner (which is a developer) to this electrostatic latent image so as to develop a toner image, and transferring this toner image to the medium which is to be the object of transfer. With this type of device, the toner cartridge which contains the above described toner is made so as to be installed in a removable manner; and, normally, a toner cartridge containing black toner is installed to a device which performs image formation in monochrome, while toner cartridges containing toners of a plurality of colors (for example a four color toner cartridge containing yellow Y, magenta M, cyan C, and black K) are installed to a device which performs image formation in color.

As such an image formation device, there is one (for example, the device described in Japanese Patent Laid-Open Publication 2004-233850, and the like) which can be used both as a device which performs image formation in monochrome as described above, and also as a device which performs image formation in color; and normally, based upon the contents of the toner cartridge or cartridges installed upon startup, such a device is started up as the appropriate device.

In more concrete terms, in the case of a device which has a monochrome mode in which it performs monochrome printing in a state in which a single toner cartridge of K (black) toner is installed, and a color mode in which it performs color printing in a state in which four toner cartridges are installed, one each for YMCK (yellow, magenta, cyan, and black) toner, the user decides by himself what toner cartridge or cartridges are appropriate for the mode in which he desires to start up the device and installs this appropriate toner cartridge or cartridges; and thereafter, according to requirements, he performs startup of the device by pushing a switch upon the device. It should be understood that, here, this mode which depends in this manner upon the toner cartridge or cartridges installed will be termed the startup mode.

In the same manner, when he desires to change over between these startup modes, the user performs the job of changing over to a toner cartridge or cartridges upon which he has decided by himself, so as to establish the state in which that toner cartridge or cartridges are installed which is required for that startup mode to which he desires to switch, and thereafter he performs a re-startup of the device, thus putting it into the desired startup mode.

However, with an image formation device like the one described above, there is a current tendency for the freedom in the colors and numbers of the toner cartridges which can be installed to increase, so that it may be expected that the number of startup modes of which a single image formation device is capable also will increase. Due to this, with a method such as one in which, as in the prior art, when changing over between startup modes, the user decides by himself upon the required toner cartridge or cartridges and performs the changeover, the burden upon the user becomes high, and moreover it also becomes easy for mistakes to occur. Accordingly, recently, improvement of such a device is desired in relation to changeover of the startup mode.

SUMMARY OF THE INVENTION

Thus, an object of the present invention is to provide an image formation device which can operate in a plurality of startup modes, in dependence upon the toner cartridge which is installed, and with which the user can perform alteration of the startup mode in a simple and easy and moreover accurate manner.

In order to achieve the above described objective, according to its one aspect, the present invention proposes an image formation device, to which a development unit containing toner is installed in a removable manner, and which performs image formation using the toner contained in the development unit, and which has a plurality of startup modes depending upon the installed development unit, comprising: a reception portion which receives an alteration request for the startup mode; a decision portion which, upon receipt of the startup mode alteration request, determines the development unit that is required to be operated, in order to start up in the requested startup mode; and an output portion which outputs guide information to a user of the image formation device, so that the determined development unit is operated. Thus, according to the present invention, when performing changevore of the startup mode, the user only has to carry out operation of the development unit based upon the guide information which has been outputted, and it is not necessary for him to decide by himself upon what operation is appropriate during the startup mode, so that, along with it becoming possible for the user to alter the startup mode in a simple and easy manner, it is also possible to prevent errors occurring during that procedure.

Furthermore, with the invention described above, according to a desirable aspect thereof, it is further proposed that, after operation of the development unit by the user based upon the guide information outputted by the output portion is completed, the image formation device should be started up in the requested startup mode. By doing this, after operation for the appropriate development unit, the user is not required to perform actuation for performing re-startup of the image formation device.

Furthermore, with the invention described above, according to another desirable aspect thereof, it is proposed that there should be further comprised a display portion for displaying the guide information outputted from the output portion.

Yet further, with the invention described above, according to another desirable aspect thereof, it is further proposed that the display portion should display the plurality of startup modes to the user; and that the startup mode alteration request should be made by the user selecting from among the plurality of startup modes displayed.

Yet further, with the invention described above, according to another desirable aspect thereof, it is further proposed that, when displaying the plurality of startup modes to the user, the display portion should not display the startup mode being used at that time point.

Yet further, with the invention described above, according to another desirable aspect thereof, it is further proposed that the decision portion should determine the development unit that is required to be operated, based upon the development unit installation state when the startup mode alteration request is received.

Yet further, with the invention described above, according to another desirable aspect thereof, it is further proposed that the decision portion should determine the development unit that is required to be operated, based upon the startup mode which is being used when the startup mode alteration request is received.

Furthermore, with the invention described above, according to another desirable aspect thereof, it is proposed that there should be further comprised a shift portion which shifts the development unit to a position in which the user can remove it, so that the development unit decided upon by the decision portion may be operated.

Other objects and features of the present invention will become clear from the following explanation of a preferred embodiment of the invention.

DESCRIPTION OF THE PREFERRED EMBODIMENTS

In the following, a preferred embodiment of the present invention will be explained with reference to the figures. However, this embodiment is not to be considered as being limitative of the technical range of the present invention. Moreover it should be understood that, in the figures and in the explanation, to elements which are the same or similar, the same reference numbers or symbols are appended.

Figure 1:
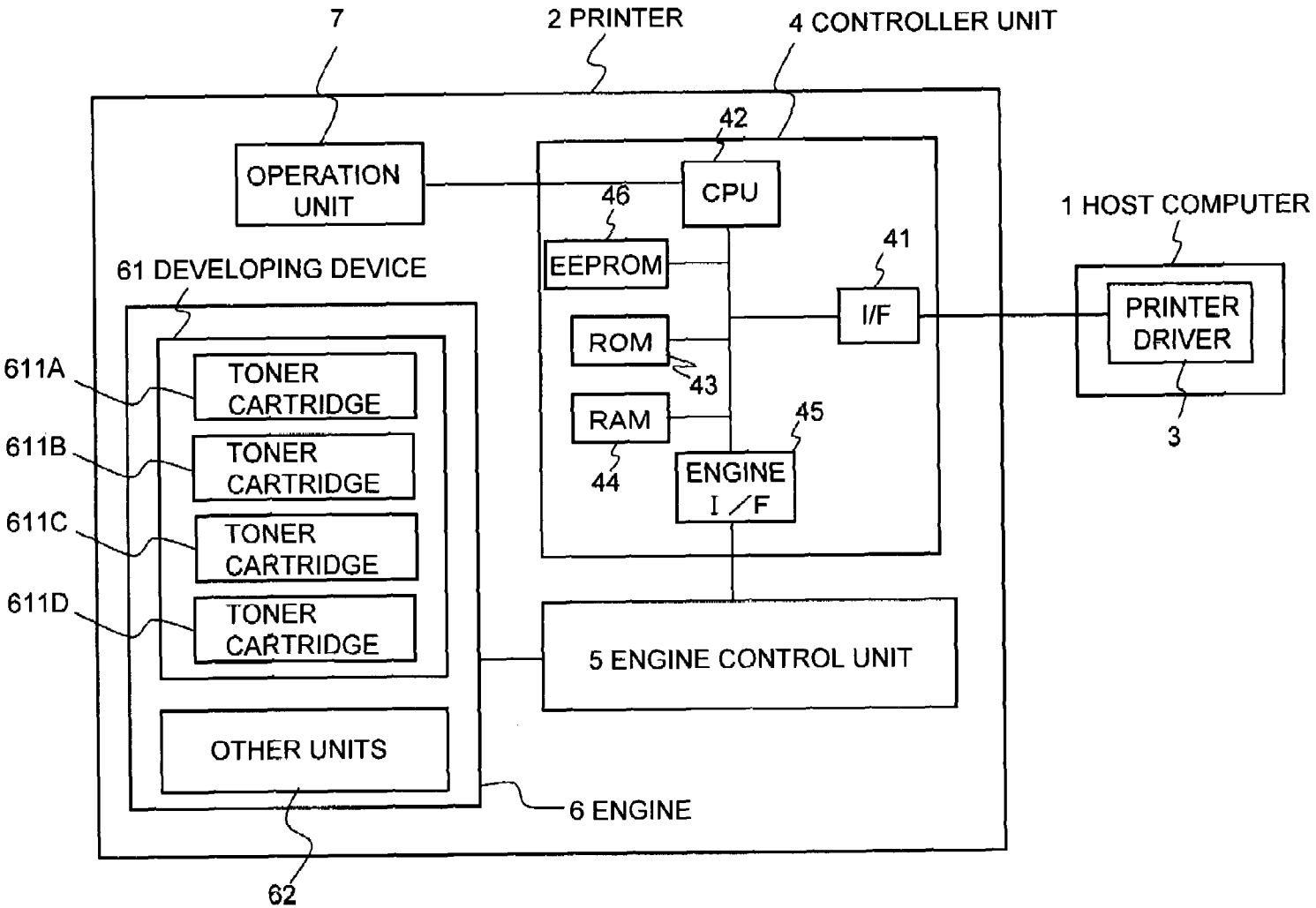
FIG. 1 is a block diagram of an embodiment of an image formation device to which the present invention has been applied.

FIG. 1 is a block diagram of an embodiment of a printer, which is an image formation device to which the present invention has been applied. The printer 2 shown in FIG. 1 is an image formation device to which the present invention has been applied, and it is a device which performs image formation upon a predetermined printing medium (paper) based upon a printing request from a host computer 1, or the like. This printer 2 has a plurality of startup modes, and it is made so that the job of changing over the startup mode may be performed simply and easily and moreover accurately: when a request is made by the user for changeover of the startup mode, the printer 2 decides upon the toner cartridges 611 (development units) over to which it is required to change, and then outputs guide information to the user, so that those toner cartridges 611 may be appropriately changed over.

The host computer 1 shown in FIG. 1 is a host device which issues a printing request to the printer 2, and it transmits printing data including image data and control commands to the printed 2, based upon operation by the user or the like. It should be understood that this host computer 1 may consist of a so-called personal computer or the like. A printer driver 3 within the host computer 1 receives data from an application within the host computer (not shown in the figures) or the like, and generates the above described printing data and transmits it to the printer 2. It should be understood that this printer driver 3 is a program which is executed for causing the host computer 1 to perform processing related to the above described function, so that the above described function is attained by a control device (not shown in the figures) of the host computer 1 performing procedures according to the program.

Next, as shown in FIG. 1, the printer 2 comprises a controller unit 4, an engine control unit 5, an engine 6, an operation unit 7, and the like; it is a so-called four-cycle laser printer. This printer 2 has three startup modes: a color mode, a monochrome quadruple mode, and a monochrome single mode.

The color mode is a mode for performing color printing, and it is a mode in which each of toner cartridges 611 for each of the colors Y, M, C, and K is installed in respectively given locations of a development device 61 which will be described hereinafter. Further, the monochrome quadruple mode is a mode for performing monochrome printing, and it is a mode in which a total of four K toner cartridges 611 are installed, one in each of the four installation locations of the development device 61. Yet further, the monochrome single mode is also a mode for performing monochrome printing, and, in this mode, a single K toner cartridge 611 is installed in a single predetermined installation location of the development device 61.

And, in order to make it possible to use the device in these various modes, the device is constructed so that it is possible also to install a K toner cartridge 611, only, in any installation location of the development device 61.

The controller unit 4 receives the printing data which is transferred from the host computer 1, and, along with interpreting the control commands included in the data, also performs predetermined processing upon the image data included in the data and generates data for supply to the side of the engine 6. As shown in FIG. 1, this controller unit 4 comprises an I/F 41, a CPU 42, a ROM 43, a RAM 44, an engine I/F 45, and an EEPROM 46.

The I/F 41 is a section which receives the printing data which is transmitted from the host computer 1, while the ROM 43 is a section which stores various programs for controlling this printer 2. And the RAM 44 is a memory which stores the printing data which has been received, and the image data for each page upon which the procedure of printing is to be performed by the engine 6 is transferred from here to the engine I/F 45.

Furthermore, the EEPROM 46 is a non-volatile memory, and it stores information which is desired to be retained without loss even when the power source to the printer 2 is turned OFF. For example information is stored in this EEPROM 46, specifying which of the three startup modes described above is set.

The CPU 42 is a section which controls various types of procedure executed by the printer 2, and, in particular, it is in charge of the procedure of storing the image data included in the printing data which has been received in the RAM 44, the procedure of interpreting the control commands included in the printing data and commanding the engine control unit 5 to perform appropriate printing procedures, the procedure of controlling the operation unit 7 to provide an interface with the user, and the like. This printer 2 is particularly distinguished by the procedure which is performed by the CPU 42 when altering the startup mode, and the concrete details thereof will be described hereinafter. It should be understood that, principally, the procedures and so on which are executed by the CPU 42 are performed according to programs stored in the ROM 43.

Next, the engine I/F 45 is a section which, during the operation of printing by the engine 6, reads out pixel data stored in the previously described RAM 44 at a predetermined timing, and transfers this data to the side of the engine 6 after having performed predetermined procedures thereupon; and it is also in charge of the interface between the controller unit 4 and the side of the engine 6. It should be understood that a memory which stores data temporarily, a decompressing unit, a screen processing unit, and the like are comprised within this engine I/F 45, although these elements are not shown in the figures; and these perform decompression of compressed data in the pixel data which has been read out from the RAM 44, while also performing screen processing for converting it to dot data and the like. Moreover, in concrete terms, this engine I/F 45 may be embodied as an ASIC.

Next, the engine control unit 5 comprises a CPU, a ROM, a RAM, and the like, although these elements are not shown in the figures; and it controls the operation of the various portions of the engine 6, as will be explained hereinafter. It should be understood that, when altering the startup mode or the like, it performs checks as to the state of installation of toner cartridges 611 in the various installation locations of the development device 61, and also performs control to shift the various installation locations of the development device 61 to a removal and fitting position.

Figure 2:
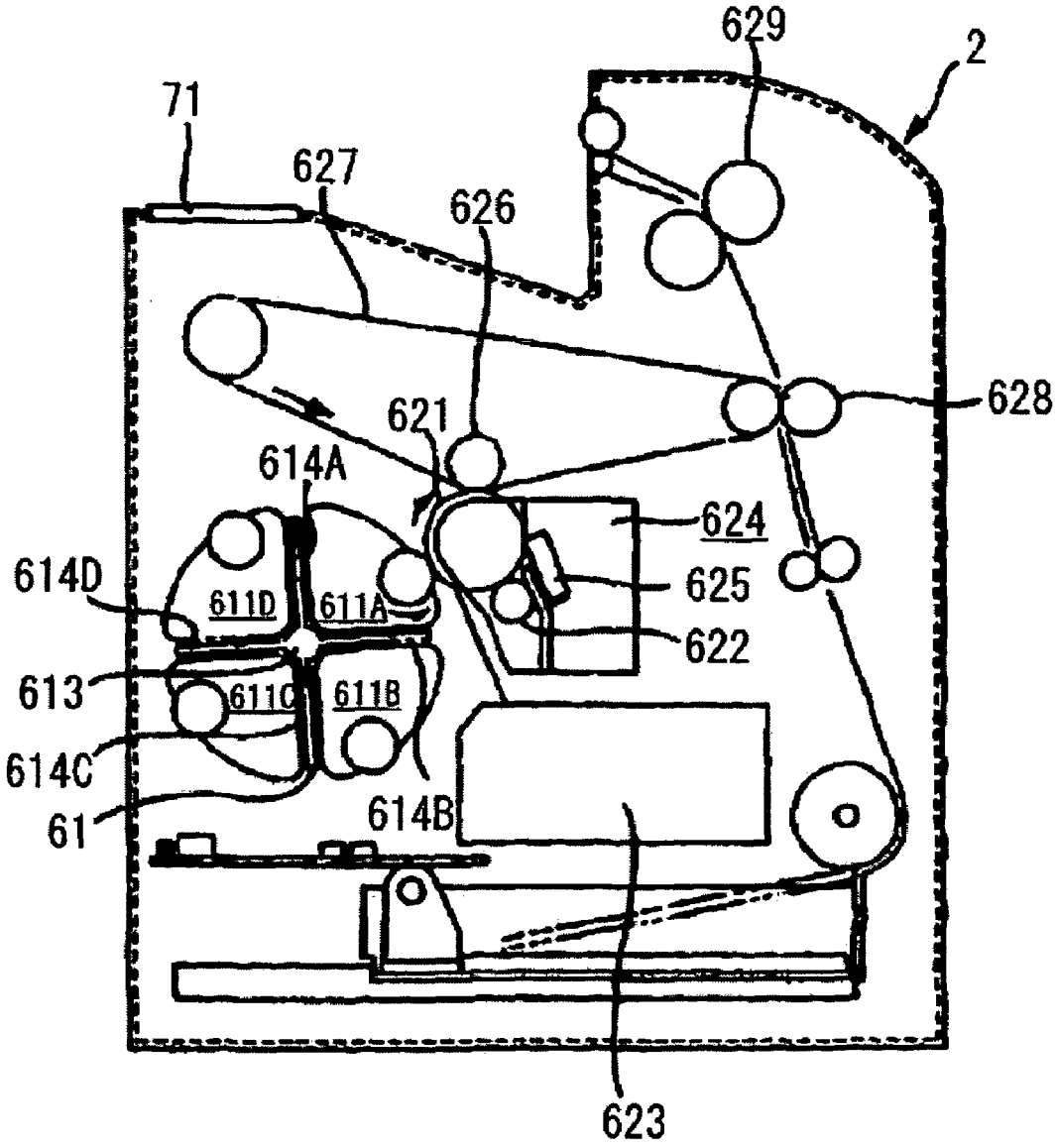
FIG. 2 is a block diagram with a focus on a portion of the mechanism of an engine 6 of this printer 2.

Next, although the engine 6 comprises an electrification unit, an exposure unit, a development device, a transfer unit, and the like, in FIG. 1, it is represented as being divided into the development unit 61 and other units 62. FIG. 2 is a block diagram with a focus on a portion of the mechanism of the engine 6 of this printer 2. A photosensitive drum 621 comprises an electrically conductive main member shaped as a circular cylinder and a photosensitive layer formed upon the outer peripheral surface of this main member, and is mounted so as to be capable of rotating around its central axis in the clockwise direction, as shown by the arrow sign in the figure. An electrification unit 622 electrifies this photosensitive drum 621, and an exposure unit 623 forms a latent image with static electricity by irradiating a beam from a light source such as an internally housed laser or LED array or the like upon the photosensitive drum 621 which has been thus electrified. This beam irradiation by the exposure unit 623 is controlled by a drive signal modulated based upon the image information which is inputted from the host computer 1.

The development device 61 comprises installation units 614A through 614D in which toner cartridges 611A through 611D containing toner, which is a development material, are installed in a removable manner, and thereby there is constituted a development rotary unit which can rotate about its central axis 613. The development device 61 is rotated so that the one of the toner cartridges 611A through 611D which is required to be used is brought to be positioned next to the photosensitive drum 621, and, by the development material in that toner cartridge 611 being supplied onto the photosensitive drum 621 upon which a latent image has been formed, that latent image is developed with the development material into an image.

It should be understood that, corresponding to the previously described three startup modes, sometimes toner cartridges 611A through 611D containing development material (toner) of the colors Y, M, C, and K respectively are installed in the installation units 614A through 614D of the development device 61, and sometimes toner cartridges 611A through 611D all containing K toner are thus installed. Furthermore, as described above, for the toner cartridges 611 for the colors Y, M, and C the installation locations are determined upon and fixed, since they are installed in the installation units 614A through 614C respectively. Furthermore, in the monochrome single mode, the toner cartridge 611 is installed in the installation unit 614D. It should be understood that the letters A through D which are appended to the toner cartridges 611A through 611D and so on, are symbols for identifying the installation positions for these toner cartridges 611 in the development device 61.

A primary transfer unit 626 transfers the toner image formed upon the photosensitive drum 621 to an intermediate transfer member 627. This intermediate transfer member 627 may be, for example, an endless belt comprising a PET film with an aluminum layer formed upon its surface by vapor deposition, and with a semiconductive coating formed upon its surface, and it is rotationally driven at the same peripheral speed as the photosensitive drum 621. And a secondary transfer unit 628 transfers the toner image which has been formed upon the intermediate transfer member 627 to a printing medium such as paper or the like, while a fixing unit 629 deposits the toner image which has been thus transferred to the printing medium onto the medium and makes it into a permanent image, with the printing medium then being ejected to the exterior of the printer 2.

A cleaning unit 624 is provided between the primary transfer unit 626 and the electrification unit 622, and comprises a cleaning blade 625 which contacts against the surface of the photosensitive drum 621, so that, after the primary transfer, the development material (toner) which remains upon the photosensitive drum 621 is removed by this cleaning blade 625.

The operation unit 7 shown in FIG. 1 is a section for the user to operate the printer 2, and it comprises a display panel 71 and an operation panel or the like. The display panel 71 is made as, for example, a LCD display or the like, and menus for operation and messages for the user and so on are displayed thereupon. Furthermore, various buttons (switches) and lamps are provided upon the operation panel. The setting for the various startup modes is performed by the user operating this operation unit 7, and, furthermore, guide information for the user when altering the startup mode and so on is displayed upon the display panel 71 or the like.

With the printer 2 according to this embodiment which has a structure like the one explained above, during printing, the printing data which has been written in a predetermined language is supplied from the host computer 1, an electrostatic latent image is formed upon the photosensitive drum 621, this image is developed with the corresponding toner cartridge 611, and transfer of the toner image to the intermediate transfer member 627 is performed by the primary transfer unit 626. And, furthermore, this image is transferred by the secondary transfer unit 628 to the printing medium such as paper or the like and is fixed by the fixing unit 629, the printing medium with the final image thereupon then being ejected to the exterior of the printer 2.

Figure 3:
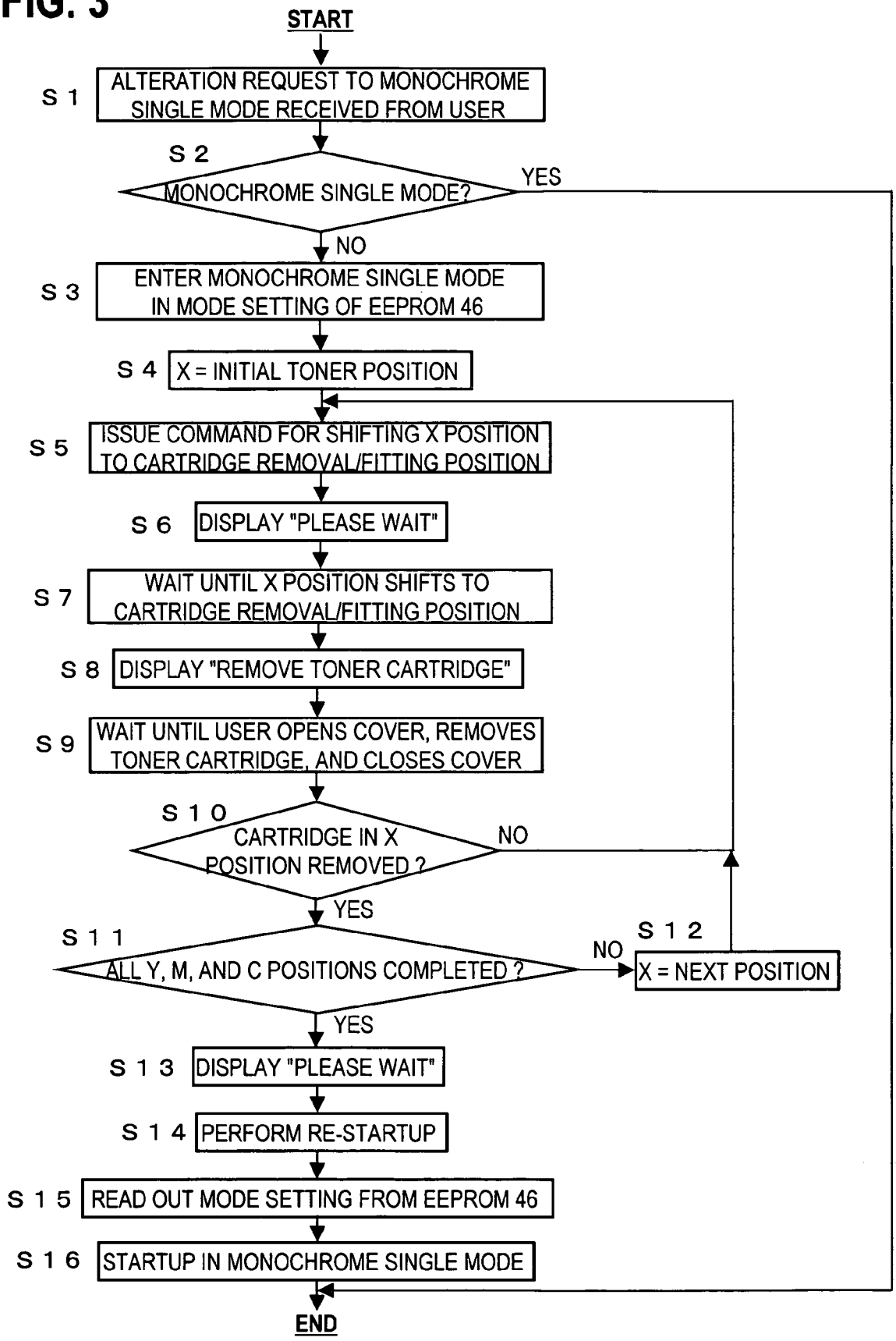
FIG. 3 is a flow chart showing an example of a procedure for changing over to the monochrome single mode.

Although the printer 2 mainly operates in this manner, with this printer 2, the distinguishing feature is the procedure when altering the startup mode described above, in other words when the user proceeds to alter the startup mode of the printer 2: in the following, these points will be explained in concrete terms. FIG. 3 is a flowchart showing an example of the procedure performed by the CPU 42 for changing over to the monochrome single mode. In the following, based upon FIG. 3, first, this procedure when changing over to the monochrome single mode will be explained.

First, if the user wants to put the printer 2 into the monochrome single mode, with the operation unit 7, he causes a menu for setting the selection of startup mode to be displayed upon the display panel 71, and then he performs operation to select the monochrome single mode from this menu, thus issuing a request for the printer to go into the monochrome single mode. And this alteration request to the monochrome single mode is received by the CPU 42 (in a step S1).

Upon receipt of this request, the CPU 42 checks whether or not the present startup mode is already the monochrome single mode (in a step S2). This check may be performed by reading out the information about the set mode at this time point which is stored in the EEPROM 46, or may be performed by detecting the actual state of toner cartridge 611 installation in the development device 61 at this time point. In the case of performing the latter type of detection, the CPU 42 outputs a command to the engine control unit 5 to this effect, and, upon receipt of this command, the engine control unit 5 accesses the development device 61, or derives the state of toner cartridge 611 installation at this time point from information related to the state of toner cartridge 611 installation which it has stored itself, and returns this information to the CPU 42.

And, if the setting mode stored in the EEPROM 46 is the monochrome single mode, or if the situation is one with a K toner cartridge 611 is installed in the position of the development device 61 in which a K toner cartridge 611 should be installed (hereinafter this will be termed the "K position"), and with no toner cartridges installed in its other positions, then the CPU 42 decides that currently the monochrome single mode is already set (YES in the step S2), and accordingly this procedure for changing over to the monochrome single mode terminates. In other words, since the current startup made is the monochrome single mode, it is not necessary to perform any alteration of the startup mode, and accordingly no alteration procedure is performed.

On the other hand, if it has been decided that the current startup mode is not the monochrome single mode (NO in the step S2), then the CPU 42 sets the contents of the mode setting stored in the EEPROM 46 to the monochrome single mode (in a step S3). By doing this, it becomes possible for it to be recognized that the startup mode which is currently set is the monochrome single mode.

Thereafter, the CPU 42 performs procedures such that the toner cartridges 611 of all the positions except the K position are removed.

In concrete terms, first, a variable X which denotes the position in which a toner cartridge 611 is installed is set to the starting position (in a step S4). As has been previously described, the installation positions in the development device 61 for the Y, M, and C toner cartridges 611, and for the K toner cartridge 611 during the color mode and during the monochrome single mode, are determined in advance, and, in the same manner as for the previously described K position, the positions in which the Y, M, and C toner cartridges 611 should be installed will be termed, respectively, the "Y position", the "M position", and the "C position". Accordingly, in this example, the Y position, the M position, and the C position respectively correspond to the installation units 614A, 614B, and 614C. If the previously described starting position is supposed to be, for example, the Y position, then X=Y comes to be set in the step S4.

Thereafter, the CPU 42 issues a command (in a step S5) so that the X position (actually, the Y position) shifts to a cartridge removal and fitting position, and, along therewith, displays the message "Please Wait" upon the display panel 71 (in a step S6). And, thereafter, it waits until this shift is completed (in a step S7), and, after the shift is completed, displays the message "Remove Toner Cartridge" upon the display panel 71 (in a step S8). It should be understood that the above described shifting to the removal and fitting position is performed by, upon receipt of the command, the engine control unit 5 causing the development device 61 to rotate around its central axis 613, and causing its X position—in other words, in this example, its Y position—to shift to a place in which the user can perform removal and fitting of the cartridge. This cartridge removal and fitting place (the place in which the user perform removal and fitting of the cartridge) is similar to the removal and fitting place showed as 37 in FIG. 6C of US2005/0013625A1. US2005/0013625A1 is hereby incorporated by reference.

Next, upon receipt of display of the above described message, the user opens the cover of the printer 2, removes the toner cartridge 611 which is shifted to the removal and fitting position, and thereafter closes the cover. The CPU 42 waits for the user to perform this operation (in a step S9), and thereafter checks (in a step S10) as to whether or not the toner cartridge 611 in the X position (here, in the Y position) has been removed. This check is performed by issuing a command to the engine control unit 5, in the same manner as the procedure shown in the step S2 of detecting the installation state of toner cartridges 611 in the development device 61 at that time point.

If the result is that a toner cartridge 611 is still installed in the X position (NO in the step S10), then the processing from the step S5 is repeated a second time. On the other hand, if the removal has been performed, so that no toner cartridge 611 is installed in the X position (YES in the step S10), then, if the procedures (the step S5 through a YES decision in the step S10) for removing the toner cartridges 611 at all of the Y, M, and C installation positions for Y, M, and C have not been completed (NO in a step S11), then the variable X is set to the next position (in a step S12).

To put it in another manner, if the removal has been performed and no toner cartridge 611 is installed in the X position (actually, in the Y position) (YES in the step S10), then the procedure of removal for the Y position, which is the starting position, terminates, and the processing moves on to the M position.

Thereafter, for the next position (the M position) procedures in order to remove the toner cartridge 611 are performed in the same manner as in the step S5 through a YES decision in the step S10. And thereafter, furthermore, for the C position as well, procedures in order to remove the toner cartridge 611 are performed in the step S5 through a YES decision in the step S10 in the same manner; and, when the procedures for removing the toner cartridge 611 have been completed for all of the installation positions for Y, M, and C (YES in the step S11), the flow of control proceeds to a step S13. At this time point, a state has been attained in which a toner cartridge 611 is installed only in the K position.

And the CPU 42 displays the message "Please Wait" upon the display panel 71 (in a step S13), and performs re-startup of the printer 2 (in a step S14). And, during this process, the mode setting information is read out from the EEPROM 46 (in a step S15), and, since the value thereof has been set to the monochrome single mode by the processing in the step S3 described above, starting up of the printer 2 in the monochrome single mode is performed (in a step S16). As a result, the printer 2 comes to be in the state in which it can perform printing in the monochrome single mode. By doing this, the procedure for changing over to the monochrome single mode is completed.

It should be understood that although, in the above described example, when an alteration request to the monochrome single mode has been received, if at this time point the startup mode is not the monochrome single mode, then the toner cartridges 611 for the positions Y, M, and C are removed and a check for this is performed, it would also be acceptable to arrange to perform a check, for the K position as well, that a K toner cartridge 611 is installed. In this case, if no toner cartridge is installed in the K position, then the K position is shifted to the removal and fitting position, and the message "Install Black Toner Cartridge" is displayed, in order to invite the user to perform installation of a K cartridge. By doing this, it becomes possible to perform a more precise procedure for changing over the startup mode.

Furthermore it may be arranged, when an alteration request to the monochrome single mode has been received, irrespective of the startup mode which is set at this time point, to perform procedures for detecting the state of the toner cartridges 611 which are installed at this time point, and for performing removal and/or installation only for those positions for which the toner cartridge 611 installation state is different from that which is appropriate for the monochrome single mode. For example if, although the installation state is not the one in which the appropriate toner cartridges for the startup mode are installed, two toner cartridges 611 are installed in the Y position and in the K position, then procedures (from the step S5 through a YES decision in the step S10) may be performed for performing removal only for the Y position. By doing this, along with it being possible to eliminate useless operations during the changing over procedure, also it is possible to perform the processing in a more precise manner.

Figure 4:
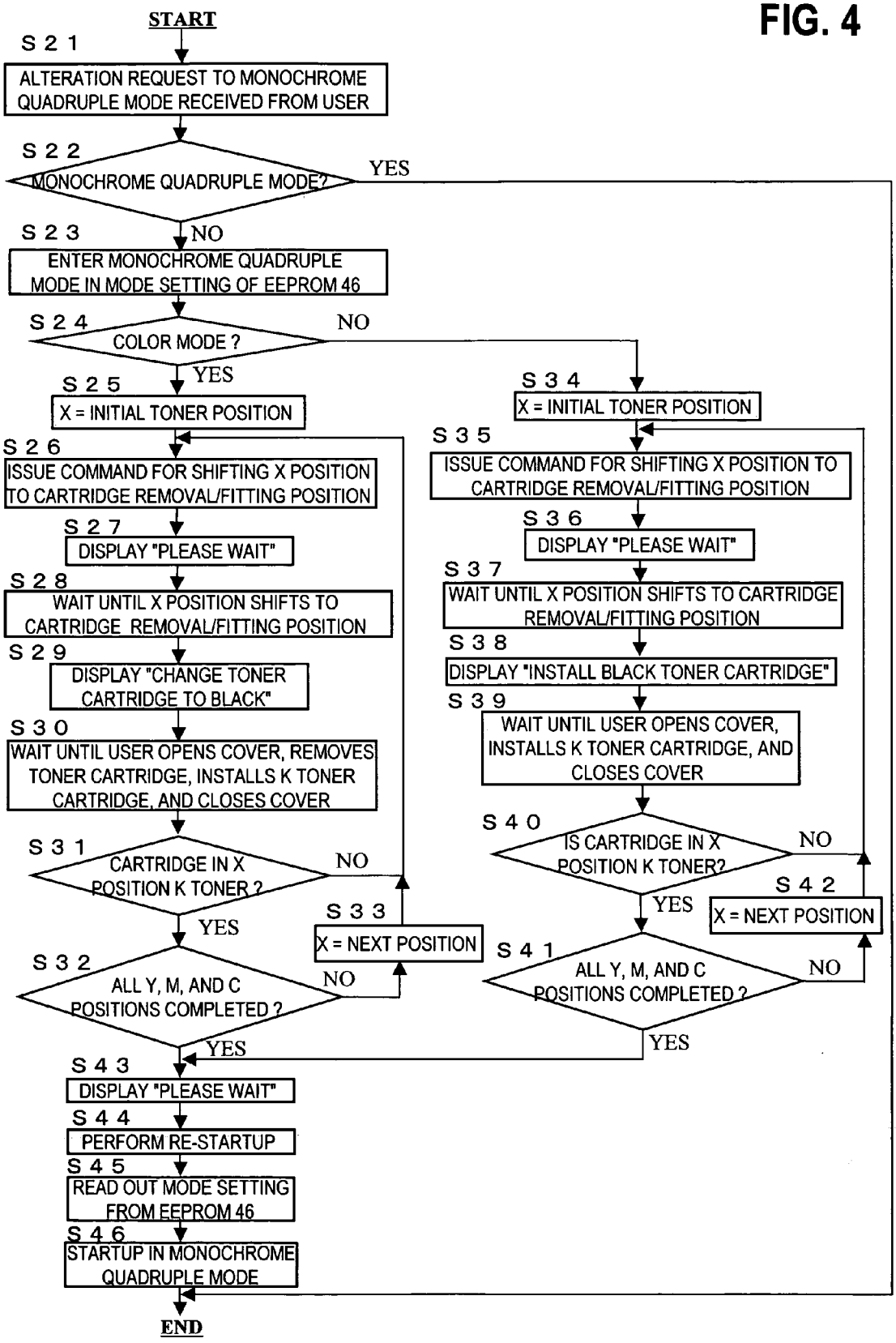
FIG. 4 is a flow chart showing an example of a procedure for changing over to the monochrome quadruple mode.

Next, the procedure for changing over to the monochrome quadruple mode will be explained. FIG. 4 is a flow chart showing an example of the procedure performed by the CPU 42 for changing over to the monochrome quadruple mode. In the following, based upon FIG. 4, this procedure will be explained in concrete terms.

First, if the user wants to put the printer 2 into the monochrome quadruple mode, upon the operation unit 7, he issues a request for change to the monochrome quadruple mode. And this alteration request to the monochrome quadruple mode is received by the CPU 42 (in a step S21).

Upon receipt of this request, the CPU 42 checks whether or not the present startup mode is already the monochrome quadruple mode (in a step S22). This check is performed in the same manner as during alteration to the monochrome single mode, described above. And, if the setting mode stored in the EEPROM 46 is the monochrome quadruple mode, or if the situation is one with K toner cartridges 611 installed in all the four installation positions of the development device 61, then the CPU 42 decides that currently the monochrome quadruple mode is already set (YES in the step S22), and accordingly this procedure for changing over to the monochrome quadruple mode terminates. In other words, since the current startup made is the monochrome quadruple mode, it is not necessary to perform any alteration of the startup mode, and accordingly no alteration procedure is performed.

On the other hand, if it has been decided that the current startup mode is not the monochrome quadruple mode (NO in the step S22), then the CPU 42 sets the contents of the mode setting stored in the EEPROM 46 to the monochrome quadruple mode (in a step S23).

Next, the CPU 42 checks (in a step S24) whether or not the current startup mode is the color mode, by an identical method. If the result is that it has been decided that the current startup mode is the color mode (YES in the step S24), then the CPU 42 performs procedures so as to make the toner cartridges 611 in all the positions except the K position be K toner cartridges 611. In other words, K toner cartridges 611 come to be installed in all the four installation locations.

In concrete terms, first, a variable X which denotes the position in which a toner cartridge 611 is installed is set to the starting position (in a step S25). In the same manner as in the previously described case of alteration to the monochrome single mode, first, X=Y is set.

Thereafter, the CPU 42 issues a command (in a step S26) so that the X position (actually, the Y position) shifts to the cartridge removal and fitting position, and, along therewith, displays the message "Please Wait" upon the display panel 71 (in a step S27). And, thereafter, it waits until this shift is completed (in a step S28), and, after the shift is completed, it displays the message "Change Toner Cartridge to Black" upon the display panel 71 (in a step S29).

Next, upon receipt of display of the above described message, the user opens the cover of the printer 2, removes the toner cartridge 611 which is shifted to the removal and fitting position, sets a K toner cartridge 611 into that position, and thereafter closes the cover. The CPU 42 waits for the user to perform this operation (in a step S30), and thereafter checks (in a step S31) as to whether or not the toner cartridge 611 in the X position (here, in the Y position) is a K toner cartridge 611. This check is performed in the same manner as in the case of alteration to the monochrome single mode.

If the result is that a K toner cartridge 611 is not installed in the X position (NO in the step S31), then the processing from the step S26 is repeated a second time. On the other hand, if a K toner cartridge 611 is installed in the X position (YES in the step S31), then a check is made as to whether the procedures (the step S26 through a YES decision in the step S31) have been completed for all of the Y, M, and C installation positions, and, if they have not been completed (NO in a step S32), then the variable X is set to the next position (in a step S33).

To put it in another manner, if a K toner cartridge 611 is installed in the Y position (YES in the step S31), then the procedure for the Y position, which is the starting position, terminates, and the processing moves on to the M position.

Thereafter, for the next position (the M position) exchange procedures for the toner cartridge 611 are performed in the same manner as in the step S26 through a YES decision in the step S31. And thereafter, furthermore, for the C position as well, the same exchange procedures are performed; and, when the procedures for exchanging the toner cartridges 611 have been completed for all of the installation positions for Y, M, and C (YES in the step S32), then the flow of control proceeds to a step S43. At this time point, a state has been attained in which K toner cartridges 611 are installed in all of the positions.

Returning to the step S24, if it has been decided that the color mode is not set (NO in the step S24), then the CPU 42 performs the procedure for installing K toner cartridges in all the positions except the K position. In other words, K toner cartridges 611 come to be installed in all of the four installation locations.

In concrete terms, the procedures of FIG. 4 from the step S34 through YES in the step S41 are performed in an identical manner to the previously described procedures from the step S25 through YES in the step S32. However, the message which is displayed after shifting to the removal and fitting position is "Install Black Toner Cartridge" (in the step S38), and the fact that, in operation by the user based thereupon, operation to remove the toner cartridge 611 is not performed (in a step S39) is different from the case of the procedures from the step S25 through YES in the step S32.

When, by doing this, the installation procedure for K toner cartridges 611 for the Y, M, and C positions (from the step S34 or S42 to YES in the step S40) is completed (YES in the step S41), then the flow of control shifts to the step S43. At this time point, a state has been attained in which K toner cartridges 611 are installed in all the four installation positions.

And the CPU 42 displays the message "Please Wait" upon the display panel 71 (in a step S43), and performs re-startup of the printer 2 (in a step S44). And, during this process, the mode setting information is read out from the EEPROM 46 (in a step S45), and, since the value thereof has been set to the monochrome quadruple mode, starting up of the printer 2 in the monochrome quadruple mode is performed (in a step S46). As a result, the printer 2 comes to be in the state in which it can perform printing in the monochrome quadruple mode. By doing this, the procedure for changing over to the monochrome quadruple mode is completed.

It should be understood that it would also be acceptable to arrange to perform a check that a K toner cartridge 611 is installed in the K position as well, in the same way as in the case of the procedure for changing over to the monochrome single mode, described above.

Furthermore it may be arranged, when an alteration request to the monochrome quadruple mode has been received, irrespective of the startup mode which is set at this time point, to perform procedures for detecting the state of the toner cartridges 611 which are installed at this time point, and for performing exchange and/or installation only for those positions for which the toner cartridge 611 installation state is different from that which is appropriate for the monochrome quadruple mode.

Figure 5:
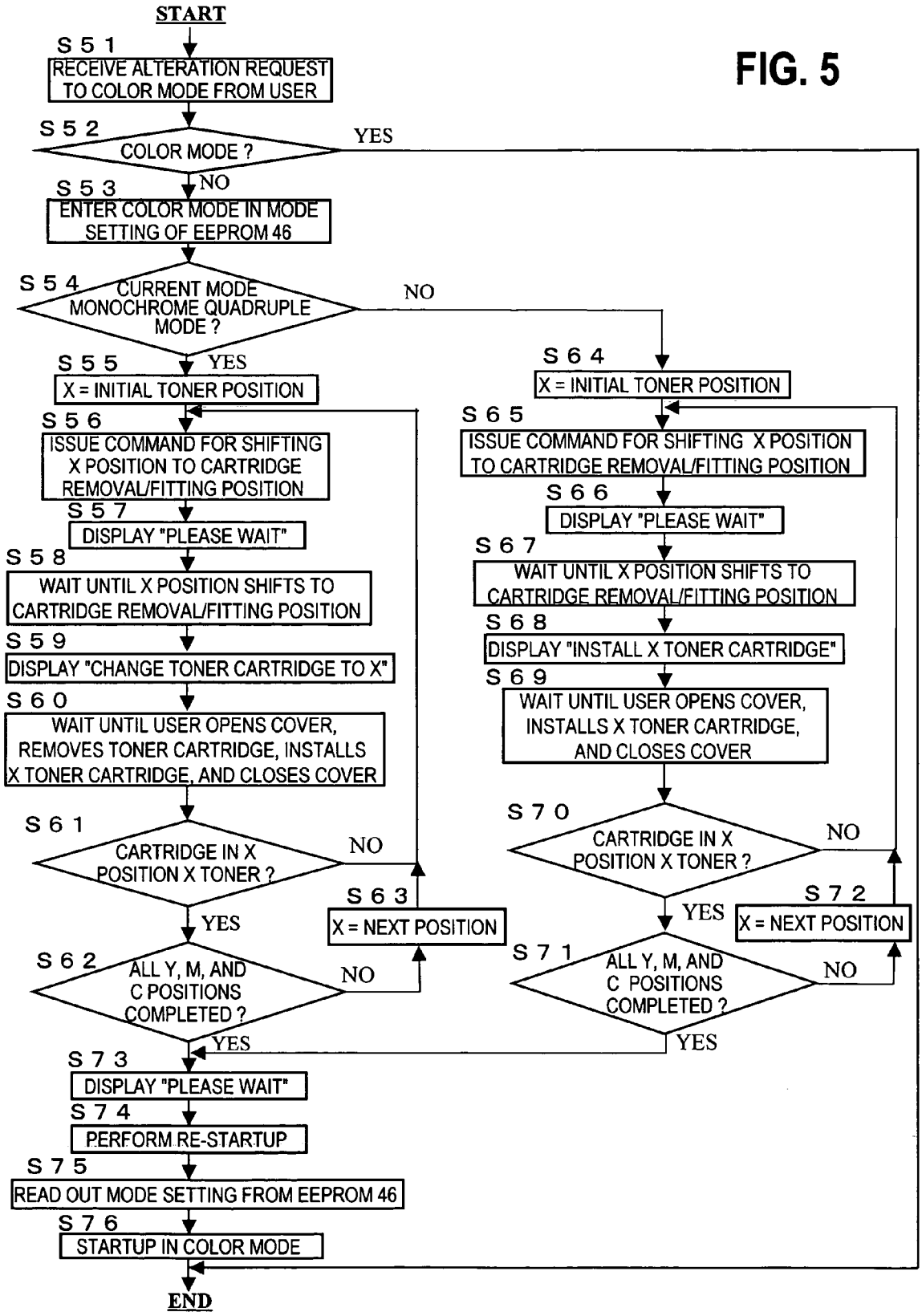
FIG. 5 is a flow chart showing an example of a procedure for changing over to the color mode.

Next, the procedure for changing over to the color mode will be explained. FIG. 5 is a flow chart showing an example of the procedure performed by the CPU 42 for changing over to the color mode. In the following, based upon FIG. 5, this procedure will be explained in concrete terms.

First, in the same way as when the user wants some other alteration as described above, he issues a request for change to the color mode by using the operation unit 7. And this alteration request to the color mode is received by the CPU 42 (in a step S51).

Upon receipt of this request, the CPU 42 checks whether or not the present startup mode is already the color mode (in a step S52). This check is performed in the same manner as in the cases of alteration to other modes, described above. And, if the setting mode stored in the EEPROM 46 is the color mode, or if the situation is one with Y, M, C, and K toner cartridges 611 correctly installed in all the four respective installation positions of the development device 61, then the CPU 42 decides that currently the color mode is already set (YES in the step S52), and accordingly this procedure for changing over to the color mode terminates.

On the other hand, if it has been decided that the current startup mode is not the color mode (NO in the step S52), then the CPU 42 sets the contents of the mode setting stored in the EEPROM 46 to the color mode (in a step S53).

Next, the CPU 42 checks (in a step S54) whether or not the current startup mode is the monochrome quadruple mode, by an identical method. If the result is that it has been decided that the current startup mode is the monochrome quadruple mode (YES in the step S54), then the CPU 42 performs procedures so as to exchange the toner cartridges 611 in all the positions except the K position. In other words, Y, M, C, and K toner cartridges 611 come to be installed in all the four respective Y, M, C, and K installation locations.

In concrete terms, first, a variable X which denotes the position in which a toner cartridge 611 is installed is set to the starting position (in a step S55). First, X=Y is set.

Thereafter, the CPU 42 issues a command (in a step S56) so that the X position (actually, the y position) shifts to the removal and fitting position, and, along therewith, displays the message "Please Wait" upon the display panel 71 (in a step S57). And, thereafter, it waits until this shift is completed (in a step S58), and, after the shift is completed, it displays the message "Change Toner Cartridge to X" upon the display panel 71 (in a step S59).

Next, upon receipt of display of the above described message, the user opens the cover of the printer 2, removes the toner cartridge 611 which is shifted to the removal and fitting position, sets an X toner cartridge 611 into that position, and thereafter closes the cover. The CPU 42 waits for the user to perform this operation (in a step S60), and thereafter checks (in a step S61) as to whether or not the toner cartridge 611 in the X position (here, in the Y position) is an X toner cartridge (here, a Y toner cartridge). This check is performed in the same manner as in the case of alteration to the other modes.

If the result is that an X toner cartridge 611 is not installed in the X position (NO in the step S61), then the processing from the step S56 is repeated a second time. On the other hand, if as X toner cartridge 611 is installed in the X position (YES in the step S61), then a check is made as to whether the procedures (the step S56 through a YES decision in the step S61) have been completed for all of the Y, M, and C installation positions, and, if they have not been completed (NO in a step S62), then the variable X is set to the next position (in a step S63).

To put it in another manner, if a Y toner cartridge 611 is installed in the Y position (YES in the step S61), then the procedure for the Y position, which is the starting position, terminates, and the processing moves on to the M position.

Thereafter, for the next position (the M position), exchange procedures for the toner cartridge 611 are performed in the same manner as in the step S56 through a YES decision in the step S61. And thereafter, furthermore, for the C position as well, the same exchange procedures are performed; and, when the procedures for exchanging the toner cartridges 611 have been completed for all of the installation positions for Y, M, and C (YES in the step S62), then the flow of control proceeds to a step S73. At this time point, a state has been attained in which appropriate toner cartridges 611 for the color mode are installed in all of the positions.

Returning to the step S54, if it has been decided that the monochrome quadruple mode is not set (NO in the step S54), then the CPU 42 performs the procedure for installing appropriate toner cartridges 611 for the color mode in all the positions except the K position.

In concrete terms, the procedures of FIG. 5 from the step S64 through YES in the step S71 are performed in an identical manner to the previously described procedures from the step S55 through YES in the step S62. However, the message which is displayed after shifting to the removal and fitting position is "Install X Toner Cartridge" (in the step S68), and the fact that, in operation by the user based thereupon, operation to remove the toner cartridge 611 is not performed (in a step S69) is different from the case of the procedures from the step S55 through YES in the step S62.

When, by doing this, the installation procedure for appropriate toner cartridges 611 for the Y, M, and C positions (from the step S64 or S72 to YES in the step S70)is completed (YES in the step S71), then the flow of control shifts to the step S73. At this time point, a state has been attained in which appropriate toner cartridges 611 for the color mode are installed in all the four respective installation positions.

And the CPU 42 displays the message "Please Wait" upon the display panel 71 (in a step S73), and performs re-startup of the printer 2 (in a step S74). And, during this process, the mode setting information is read out from the EEPROM 46 (in a step S75), and, since the value thereof has been set to the color mode, starting up of the printer 2 in the color mode is performed (in a step S76). As a result, the printer 2 comes to be in the state in which it can perform printing in the color mode. By doing this, the procedure for changing over to the color mode is completed.

It should be understood that it would also be acceptable to arrange to perform a check that a K toner cartridge 611 is installed in the K position as well, in the same way as in the case of the procedures for changing over to the other modes, described above.

Furthermore it may be arranged, when an alteration request to the color mode has been received, irrespective of the startup mode which is set at this time point, to perform procedures for detecting the state of the toner cartridges 611 which are installed at this time point, and for performing exchange and/or installation only for those positions for which the toner cartridge 611 installation state is different from that which is appropriate for the color mode.

It should be understood that, in the embodiment described above and explained based upon FIGS. 3, 4, and 5, it would also be acceptable, in order for the user to issue an alteration request for the startup mode, to arrange not to display the currently set startup mode in a menu which is displayed upon the display panel 71. For example, by the monochrome single mode not being shown when displaying the menu when the monochrome single mode is set, the user cannot issue an alteration request to the monochrome single mode by selecting this monochrome single mode. By doing this, along with making it possible to eliminate the mistaken operation of the user uselessly trying to change over to a startup mode which is already set, it also makes it possible to eliminate the check (the step S2 of FIG. 3, the step S22 of FIG. 4, and the step S52 of FIG. 5) as to whether on not, currently, the startup mode for which an alteration request has been received is already set.

As has been explained above, with the printer 2 according to this embodiment, there is provided a menu for the user to select and set his desired startup mode from among the three startup modes with which the printer 2 is provided, and, when an alteration request is made upon this menu for alteration of the startup mode, the toner cartridge or cartridges 611 which require the operation for altering the startup mode are determined, and output of guide information (a message) to the user and shifting operation of the development device 61 and so on are performed, so that appropriate operation of the toner cartridges 611 may be performed. Accordingly, when changing over the startup mode, the user can perform effective operation based upon this message which is displayed, so that it becomes possible to change over the startup mode in a simple and easy manner without mistakes.

Furthermore, since the printer 2 performs its re-startup procedure in the final step during the procedure for changing over the startup mode, and the printer 2 comes to be in a state in which it has been started up in the mode requested by the user, accordingly it is not necessary for the user to perform actuation for the re-startup himself, so that it is possible for printing to be started directly.

Yet further since, during the above described procedure for alteration of the startup mode, after operations such as changing over the toner cartridges 611 and the like have been performed by the user, it is checked whether or not the installation state of the toner cartridges 611 is appropriate, and the processing is not completed until the installation state does become appropriate, thereby the processing for alteration of the startup mode is reliably and accurately performed.

Even further, as previously described, by arranging not to display the startup mode which is currently set upon the menu for issuing an alteration request for the startup mode, it is possible to eliminate useless user actuation, as well as some of the processing by the printer 2.

It should be understood that although, in this embodiment, three modes were provided as startup modes, the number of startup modes is not to be considered as being limited to these three.

Moreover although, in this embodiment, alteration requests for the startup mode and display of messages to the user were performed via the operation unit 7 of the printer 2, it may also be arranged for these to be performed by the host computer 1. In other words, the user may issue an alteration request for the startup mode via an interface screen which is presented by the printer driver 3 or the like of the host computer 1, and the subsequent guide information may be displayed upon the display device of the host computer 1 by being sent from the printer 2 to the host computer 1.

Furthermore although, in the embodiment, the image formation device was a printer, the present invention may also be applied to an image formation device of a different type, such as a photocopier or a facsimile machine or the like.

The range of protection of the present invention is not to be considered as being limited by the above described embodiment; it covers any invention which comes within the scope of the Patent Claims below, as well as equivalents thereof.

What is claimed is:

1. An image formation device, to which a development unit containing toner is installed in a removable manner, and which performs image formation using the toner contained in the development unit, and which has a plurality of startup modes depending upon the installed development unit, comprising:

a reception portion which receives an alteration request for a startup mode;

a decision portion which, upon receipt of the startup mode alteration request, determines the development unit that is required to be operated, in order to start up in the requested startup mode;

an output portion which outputs guide information to a user of the image formation device, so that the determined development unit is operated; and a display portion which displays the guide information outputted from the output portion, wherein:

the display portion displays the plurality of startup modes to the user;

the startup mode alteration request is made by the user selecting from among the plurality of startup modes displayed; and when displaying the plurality of startup modes to the user, the display portion does not display the startup mode being used at that time point.

2. The image formation device according to claim 1, wherein, after operation of the development unit by the user based upon the guide information outputted by the output portion is completed, the image formation device is started up in the requested startup mode.

3. The image formation device according to claim 1, wherein the decision portion determines the development unit that is required to be operated, based upon the development unit installation state when the startup mode alteration request is received.

4. The image formation device according to claim 1, wherein the decision portion determines the development unit that is required to be operated, based upon the startup mode which is being used when the startup mode alteration request is received.

5. The image formation device according to claim 1, further comprising a shift portion which shifts the development unit to a position in which the user can remove the same, so that the development unit decided upon by the decision portion is operated.

6. The image formation device according to claim 1, further comprising a shift portion which shifts the development unit to a position in which the user can install the same, so that the development unit decided upon by the decision portion is operated.

* * * * *